US005426799A

United States Patent [19]

Ottiger et al.

[11] Patent Number: 5,426,799

[45] Date of Patent: Jun. 27, 1995

[54] MATTRESS SYSTEM

[75] Inventors: Ernst Ottiger, Hochdorf; Daniel Gloor, Sursee, both of Switzerland

[73] Assignee: Superba S.A., Büron, Switzerland

[21] Appl. No.: 42,852

[22] Filed: Apr. 5, 1993

Related U.S. Application Data

[63] Continuation of Ser. No. 801,146, Dec. 2, 1991, abandoned.

[51] Int. Cl.[6] ..... A47C 23/00

[52] U.S. Cl. ..... 5/476; 5/258; 5/264.1; 5/247; 5/249; 267/81; 267/151

[58] Field of Search ..... 267/80, 81, 85, 142, 267/143, 144, 151; 5/247, 249, 251, 255, 258, 263, 264.1, 448, 461, 468, 476, 200.1

[56] References Cited

U.S. PATENT DOCUMENTS

| | | | |
|---|---|---|---|
| 298,927 | 5/1884 | Wildermuth | 5/264.1 X |
| 1,742,035 | 12/1939 | Hise | 5/251 |
| 2,179,148 | 11/1939 | Gorlofson . | |
| 2,233,527 | 3/1941 | Hamblin | 5/461 X |
| 2,321,790 | 6/1943 | Bass | 5/476 |
| 2,433,012 | 1/1947 | Zalicovitz | 267/142 X |
| 2,434,641 | 1/1948 | Burns . | |
| 2,445,158 | 7/1948 | Sparhawk . | |
| 2,494,432 | 1/1950 | Elder | 5/247 |
| 2,611,138 | 9/1952 | Piliero | 5/247 |
| 2,799,323 | 7/1957 | Berg . | |
| 2,979,739 | 4/1961 | Krakauer | 5/476 |
| 3,031,690 | 5/1962 | Ramsay . | |
| 3,081,129 | 3/1963 | Ridder . | |
| 3,618,144 | 11/1971 | Frey et al. | 5/448 X |
| 3,656,190 | 4/1972 | Regan et al. . | |
| 3,665,529 | 5/1972 | Slominski | 5/264.1 |
| 3,707,009 | 12/1972 | Wagner | 5/448 |
| 3,765,038 | 10/1973 | Curtis . | |
| 3,950,797 | 4/1976 | Bronstien . | |
| 4,190,914 | 3/1980 | Diallo . | |
| 4,222,134 | 9/1980 | Degen . | |
| 4,592,106 | 6/1986 | Hagemeister . | |
| 4,644,593 | 2/1987 | O'Brien . | |
| 4,736,932 | 4/1988 | Haslim | 5/247 X |
| 4,895,352 | 1/1990 | Stumpf | 267/80 |
| 4,956,884 | 9/1990 | Hwang | 5/258 X |
| 4,965,898 | 10/1990 | So | 5/448 X |
| 5,044,027 | 9/1991 | Moon | 5/468 X |

FOREIGN PATENT DOCUMENTS

| | | |
|---|---|---|
| 0383260 | 6/1987 | Austria . |
| 0004806 | 5/1879 | Germany . |
| 0012402 | 2/1881 | Germany . |
| 0067765 | 4/1892 | Germany . |
| 0104447 | 8/1898 | Germany . |
| 610708 | 3/1935 | Germany . |
| 2732833 | 2/1978 | Germany . |
| 2942174 | 4/1981 | Germany . |
| 3336324 | 4/1985 | Germany . |
| 8814506 | 5/1989 | Germany . |
| 474982 | 8/1969 | Switzerland . |
| 483234 | 2/1970 | Switzerland . |
| 506275 | 6/1971 | Switzerland . |
| 0616574 | 4/1980 | Switzerland . |
| 0625115 | 9/1981 | Switzerland . |
| 2088206 | 6/1982 | United Kingdom . |
| 2098860 | 12/1982 | United Kingdom . |
| 2179851 | 3/1987 | United Kingdom . |
| 8001980 | 10/1980 | WIPO . |
| 8600006 | 1/1986 | WIPO . |
| 8603663 | 7/1986 | WIPO . |

*Primary Examiner*—Michael F. Trettel
*Attorney, Agent, or Firm*—Egli International; Christa Hildebrand

[57] ABSTRACT

The invention relates to a generic mattress system which is easily adjustable to differing and space varying stresses with limiting spring paths. It has a top mattress and a bottom mattress with supporting elements connected to a frame and located in the plane of a frame. The elements are in U-shape and bear elastic support elements fastened to crosspieces. The upper mattress can also have spring elements between the upper and lower support, with each spring element having a section of elastic material.

23 Claims, 8 Drawing Sheets

MATTRESS SYSTEM

This is a continuation application of Ser. No. 07/801,146, filed Dec. 2, 1991, now abandoned.

BACKGROUND OF THE INVENTION

1. Field of Invention

The invention relates to a mattress system with an upper mattress and a lower mattress.

2. Description of Related Art

With the most widely known constructions on the market, the lower mattress comprises connecting carrier elements in the shape of laterally running boards on top of which the upper mattress lies with a typically rectangular frame. That has the disadvantage that the boards are either very stiff and have practically no spring effect, which can be only partially balanced out by flexible suspension of the same; or in case they are flexible, an unbalanced spring effect is considerably stronger in the middle than at the edge. In the latter case, the boards sag because of a larger stress in the middle in an undesired dimension, especially with wide beds. Constructions are indeed known that achieve an improvement of the simple board construction (CH-PS 506 275, CH-PS 483 234, CH-PS 474 982) by inserting intermediate supports and other construction elements. Still, they cannot remove an intrinsic weakness of the lower mattress' boards, despite the partly substantial constructive effort, namely that the spring characteristic is specifically variable only in the longitudinal direction up to a certain degree and is, thus, adjustable to the different frame stress. Similar is the problem with the upper mattresses, where the conventional spring cores with helical springs essentially show the same spring characteristics.

SUMMARY OF THE INVENTION

The invention has the objective to produce a genetic mattress system which is easily adjustable to differing and space-varying stresses, and additionally shows limited spring paths.

The invention, as it is indicated in the claims, produces a mattress system, such that it allows additional advantageous development, whose specific characteristics are described further below.

BRIEF DESCRIPTION OF THE DRAWINGS

In the following, the invention will be further explained by only one example of the depicted figures, or drawings.

They depict

Figure 1:
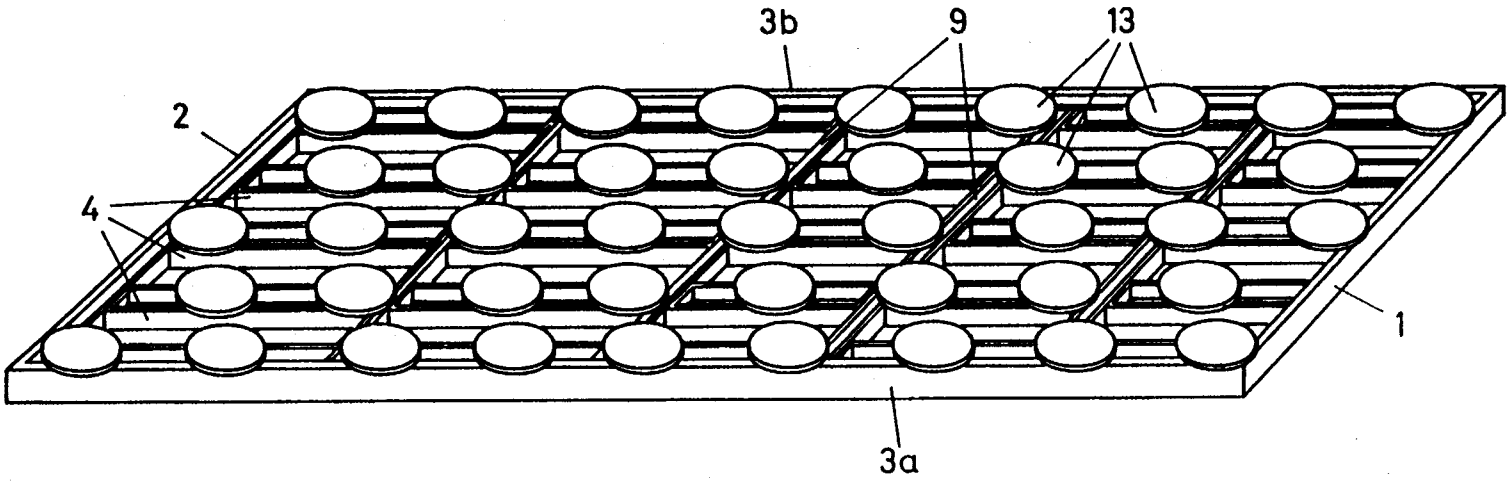
FIG. 1 a diagonal plan of a lower mattress,according to the invention.
Figure 2:
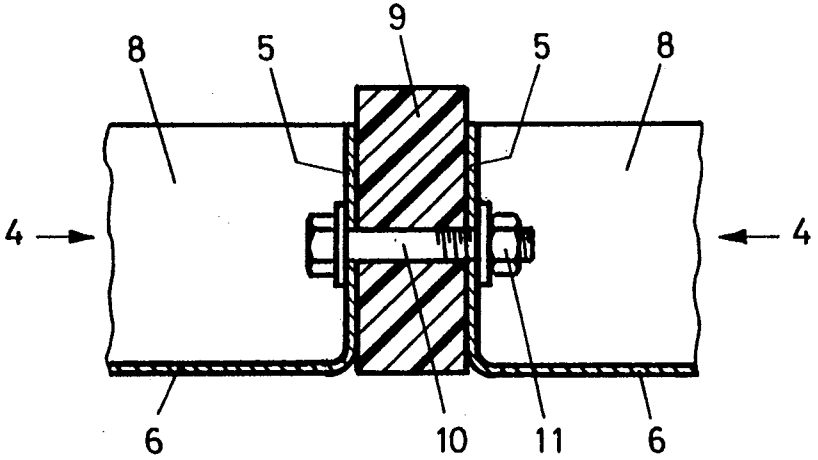
FIG. 2 a section from a longitudinal section through a lower mattress, according to FIG. 1, FIGS. 3*a,b,c* various sections through a component (support element) of a lower mattress according to one of the first versions according to the invention, FIG. 4 the spring's characteristic curve of the component according to FIGS. 3*a,b,c*, FIG. 5*a,b;c* various sections by a support element according to a second version according to the invention and 5*d* in one section according to 5*a*, a manufacturing step during the production of a lower mattress according to the second version, FIG. 6 a plan of a lower mattress according to a second version, FIG. 7*a,b* sections through further versions of the support element, FIG. 8 a plan of a lower mattress according to a variant, FIG. 9 a cut of an upper mattress according to the invention, FIG. 10 numerous versions of a component (spring dement) of an upper mattress according to the invention, FIG. 11 a lower mattress according to the invention, which comprises numerous swivel-connected frame parts, FIG. 12 one of the first types of connection between neighboring frame parts, and FIG. 13 a second type of connection between neighboring frame parts.

The lower mattress of the mattress system shows a stiff rectangular frame with a head part 1, a foot part 2 and side parts 3*a,b*, as well as a number of carder elements (FIG. 1,2).

According to the invention, the carrier elements 4 are structured in a U-shape open at the top and are sealed off at both ends by lateral walls 5. They carry fastened flexible support elements 7 at their cross-pieces 6 which project beyond their side legs 8 in the released- to the normally-stressed condition. The frame is strengthened by the cross-members 9 connected by the side parts 3*a*, 3*b*, on which the U-shaped carrier elements 4 are preferably fastened opposite each other; that is using one of their lateral walls 5 and the penetrating bolts 10 positioned in between the cross-members 9 which is secured by using a nut 11. Of course, it is possible to fasten the U-shaped carrier elements 4 by using other methods, either with wooden screws or bolts which are screwed into a threaded bushing penetrating the cross-members 9. The cross-members 9 and the U-shaped carrier elements 4 are preferably made out of—possibly fiber-strengthened—plastic.

Figure 3B:
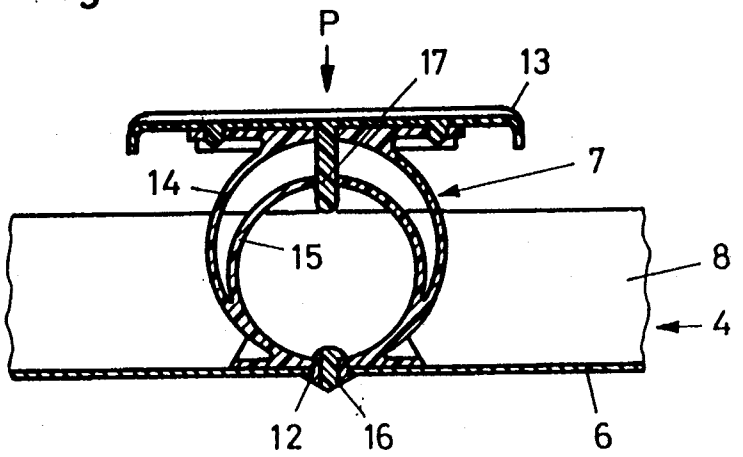
Figure 3C:
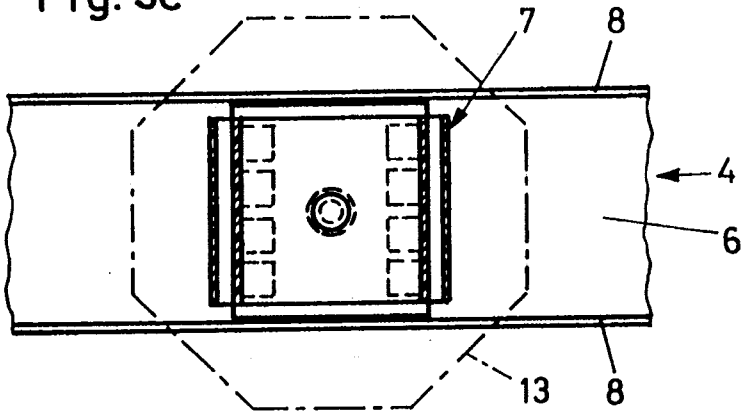
Figure 3A:
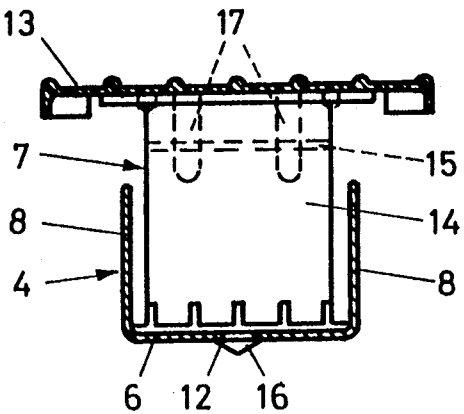

According to a first version (FIG. 3*a,b,c*), the U-shaped carrier elements 4 show numerous perforations 12, which could fasten a support element 7. The support elements 7 carry rest plates 13 to support the upper mattress, which could have various shapes, i.e. round (FIG. 1), octagonal (FIG. 3*a,b,c*), hexagonal, etc. The distribution of the cross-members 9 can be adjusted to the expected stress distribution, in order to alter the distribution of the support elements 7, which are variable in two dimensions and between surface covering—especially when using rectangular or hexagonal support plates 13—and relatively thin, in a somewhat less stressed region in the vicinity of the foot end.

Each support element 7 encompasses a first, outer tube section 14 out of flexible material, on which the rest plate 13 sits and a second, inner tube section 15 which is surrounded by the outer tube section 14 and below, where the support element 7 is affixed and connected with the snap connection formed by a projection 16 of the same and the perforation 12 in the cross-piece 6 of the U-shaped carrier elements 4. The tube sections 14, 15 are designed laterally to the U-shaped carrier elements 4, so that it is impossible to tilt the support element 7 in this direction by the side legs 8 of the U-shaped carrier elements 4. Besides, the rest plate 13 only shows two pins 17 to stabilize the sides of the support element 7 which rise through openings in the outer tube section 14 and in the inner tube section 15.

Figure 4:
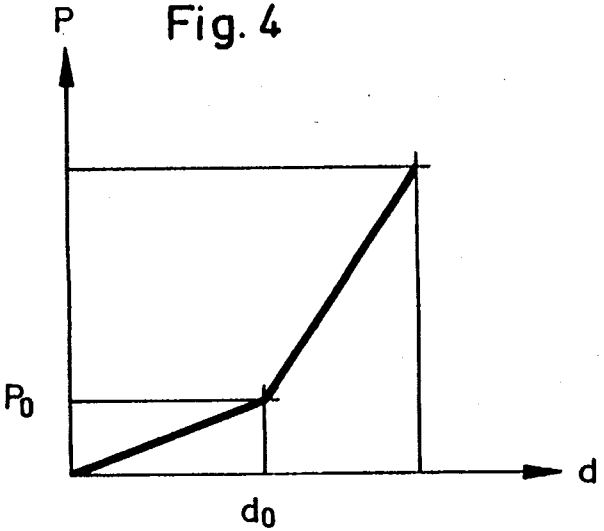

With less stress P, only the outer tube section 15 becomes deformed, so that the support element 7 is quite soft in this region. Should the deformation d attain the value dO (FIG. 4) corresponding to a stress of P0, then the outer tube section 14 is set upon the innertube section 15 and this must also be deformed during continued increase in stress and deformation. This causes a considerable increase of the spring constant and slows down any further deformation, so that a hard mounting of the remaining rest plate 13 onto the side legs 8 of the U-shaped carrier elements 4 is hindered. The aforesaid mounting of the rest plate 13 also hinders the damage of the support elements 7 during overstress. The support elements 7 preferably comprise plastic, i.e. an Elastomer; and the rest plates 13 comprise hard plastic.

Figure 5B:
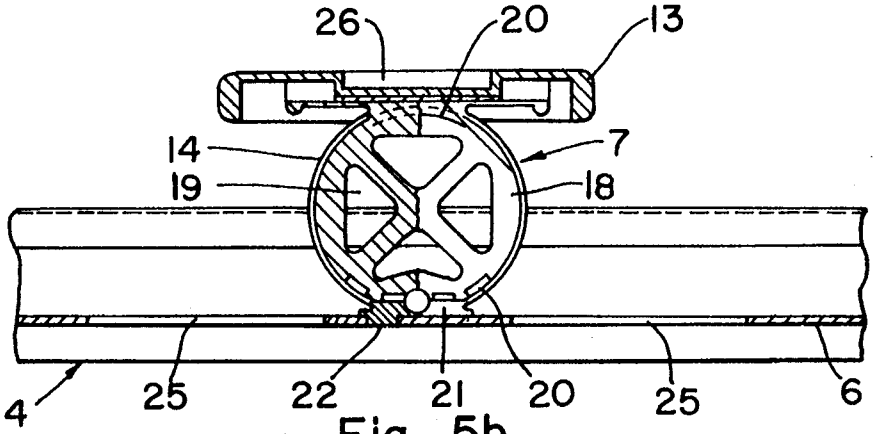
Figure 5C:
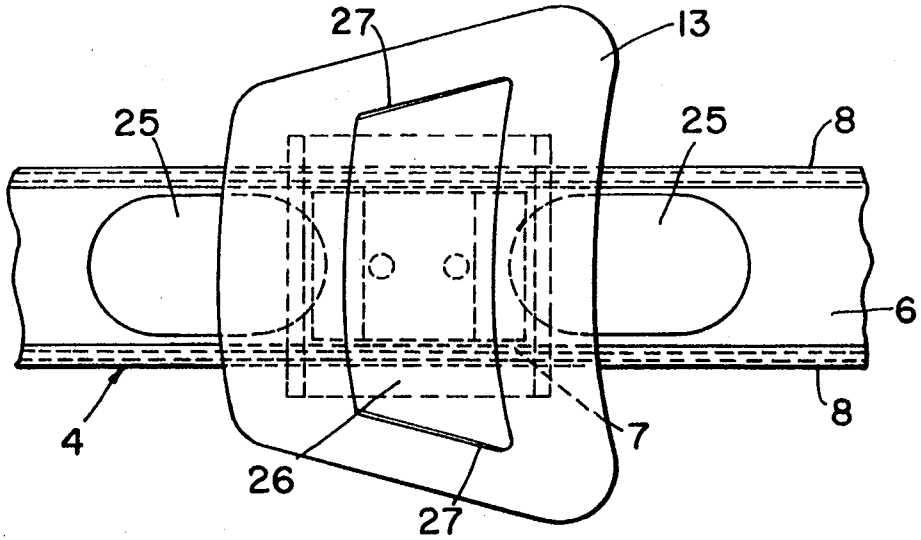
Figure 5A:
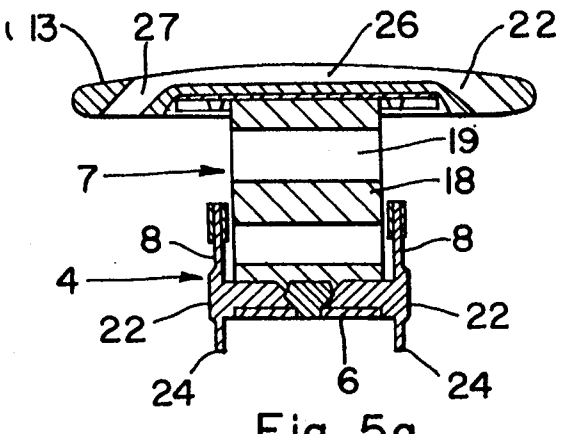
Figure 5D:
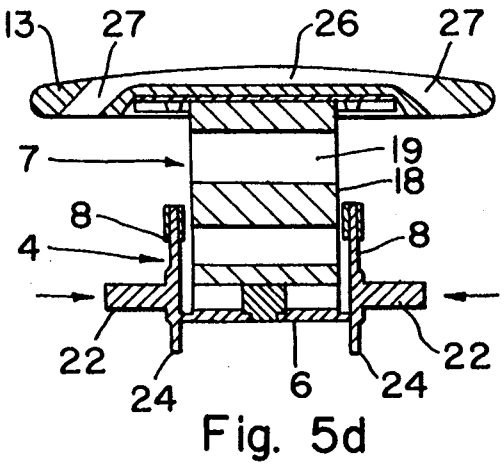

According to a second version of the lower mattress (FIG. 5*a,b,c*) according to the invention, the support elements 7 contain only one tube section 14. A rubber cylinder 18 with slots 19 going in the axial direction is pushed into the same tube to support the tube section 14 which is affixed by front stops 20 and rear stops 21. The support element 7 is held fast by rising locking bolts 22 located in the tube section 14 on both sides in the side legs 8 of the U-shaped carrier elements 4. The U-shaped carrier elements 4 is completed to improve its statistical characteristics by slats 24 in the continuation of the side legs 8 to a structure with a lateral section closer to an H-shape. For the purpose of hindering a hard mounting of the rest plate 13, the side legs 8 are provided with a rubber support above. Alternatively, rising projections could be formed to the rubber cylinder 18 through the side legs 8. The cross-piece 6 is interrupted by exceptions 25 between the places carrying the support elements 7. This is how the storage of dust is hindered. The rest plate 13 is bombarded and has a trapezoid-like shape, whereby the base of the trapezoid is concave and the opposite side is bent correspondingly convex. The material is hard plastic. To hinder a sliding of the upper mattress, the surface is roughened by erosion or by inserting structures. A trapezoidal deepening 26, led into the air passages 27, on the one hand, serves to air out the upper mattress and, on the other hand, to strengthen the braking effect of the surface of the rest plate 13 designed against a sliding of the same. The connection to the support element 7 is manufactured by a snap connection. The fastening of the support elements 7 at the U-shaped carrier elements 4 ensues as such: the locking bolts 22 fit perfectly outside the side legs 8 (FIG. 5*d*), however, the nominal breaks show. This allows the locking bolts to be beaten inward (arrows) after placing the support element 7, whereafter they get stuck due to their slightly conical structure in the side legs 8 and, as already mentioned, rise in the tube section 14 and fasten it.

Figure 6:
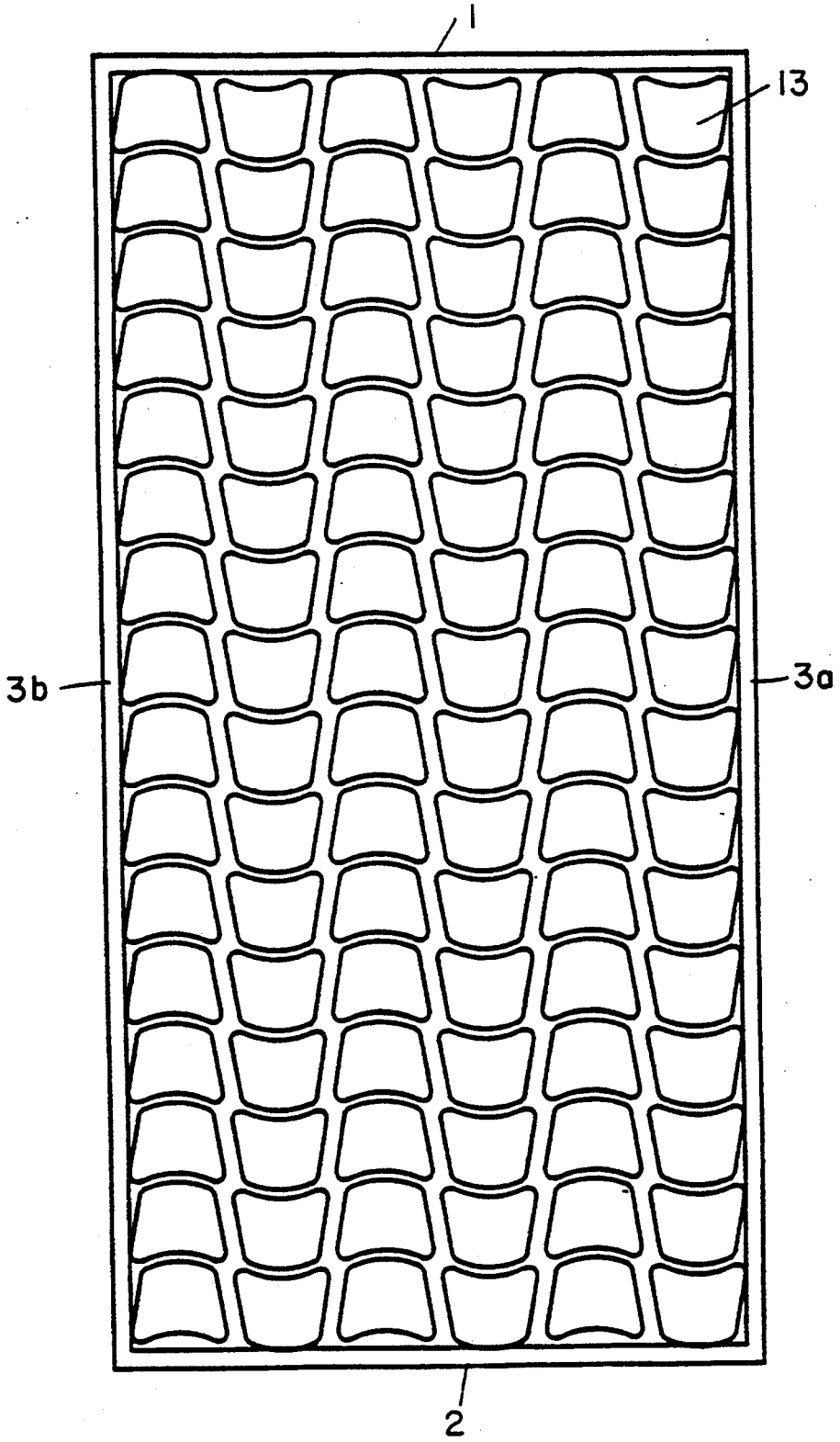

FIG. 6 indicates the distribution of the support elements and rest plates. The shape of the rest plates 13 allows for an uninterrupted covering of the area enclosed by the frame. Thus, the borders between the neighboring rest plates 13 do not form any continuous straights. A tilting of the support elements, which could lead to the forming of culverts, is then avoided. It is possible to use support elements of varying hardness, respectively at the stress expected in a specific zone. To ease the assembly, the support elements of varying degrees of hardness could be marked by various colors of the rest plate 13.

Figure 7A:
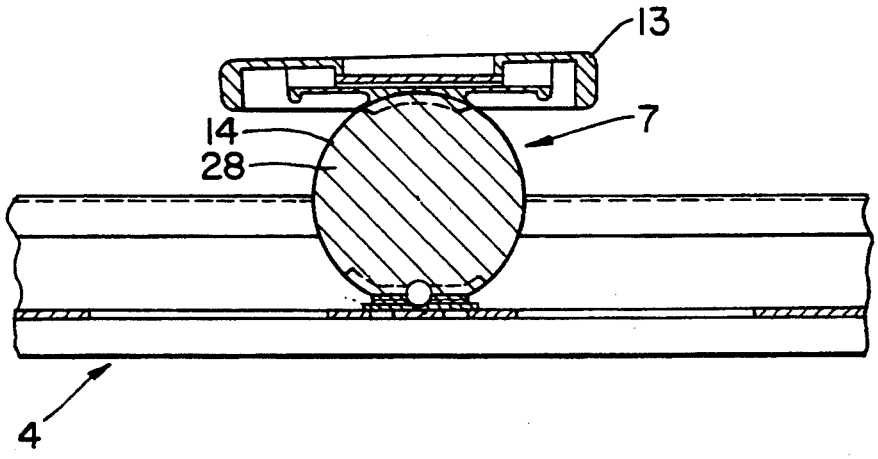
Figure 7B:
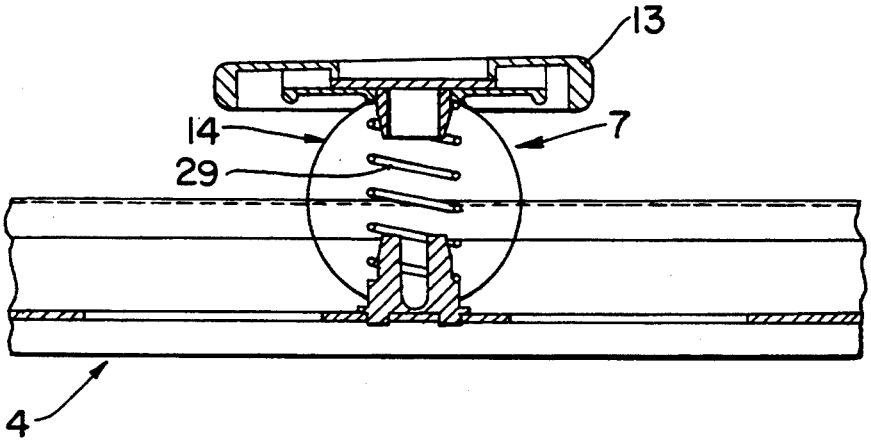

In the drawings 7*a,b*, variants of support elements 7 are depicted where the spring element supporting the tube section 14 is designed as a non-porous plastic foam cylinder with skin 28, or as a coil spring 29 out of antimagnetic chrome-nickel steel covered with plastic. The spring's characteristic curve is close to becoming a straight according to the support elements 7 depicted in FIG. 7*a,b*, as well as those depicted in FIG. 5*a,b,c,d*.

Figure 8:
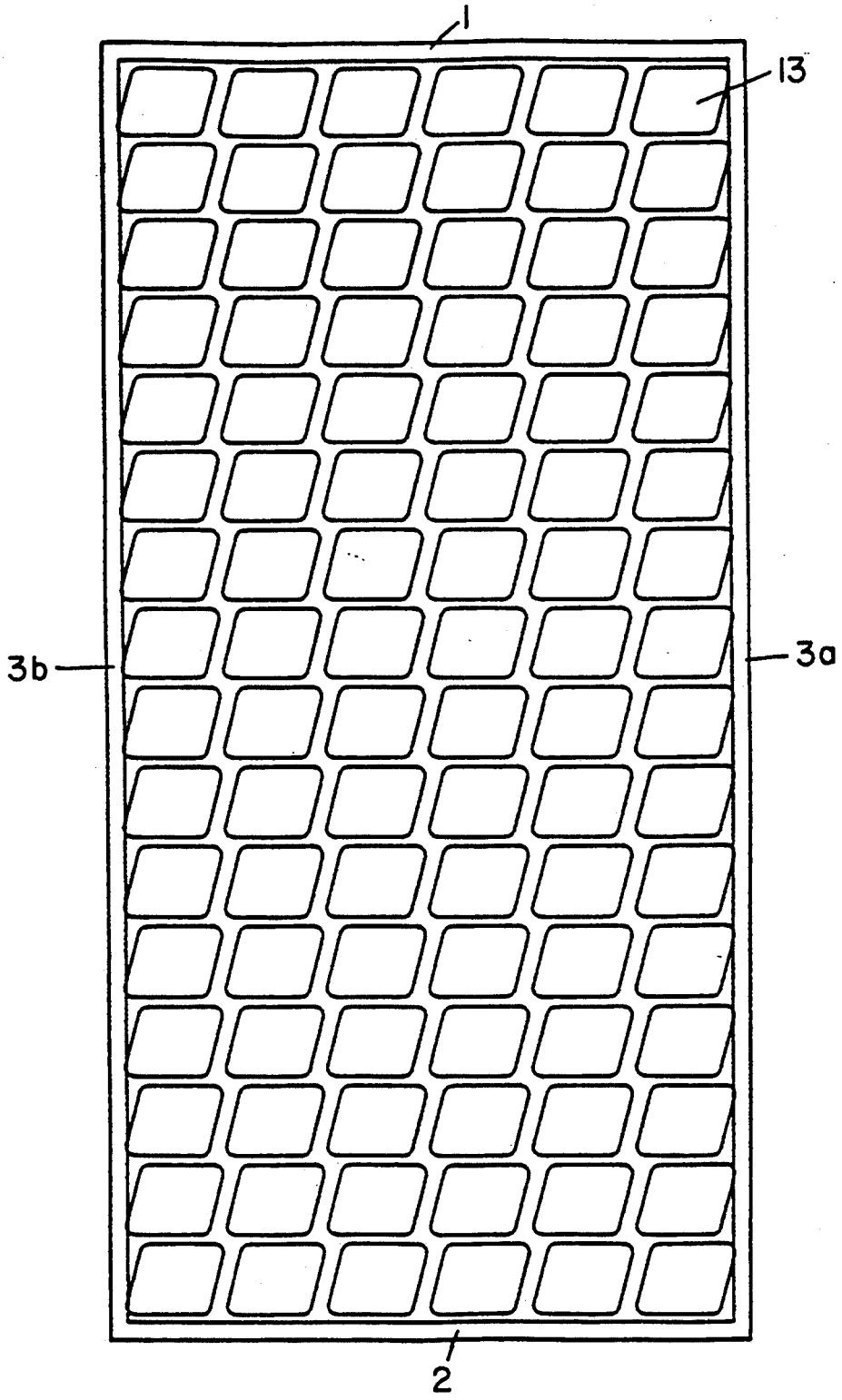

A variant with parallelogram-shaped rest plates 13 is depicted in FIG.8, as well as a possible arrangement of the support elements in the area enclosed by the frame. Here, the borderlines between neighboring support elements do not form any continuous straights in the longitudinal direction which is usually sufficient for hindering the forming of culverts.

All of the versions have the advantage that they are modularly designed and are thus, adjustable to any measurements—by adjusting the number of U-shapes next to each other in the width and the number of the cross-pieces 9 in the length.

The objective of the invention can be solved by a version of the upper mattress according to the invention instead of a special version of the lower mattress—or especially advantageous in connection with the same thing.

Figure 9:
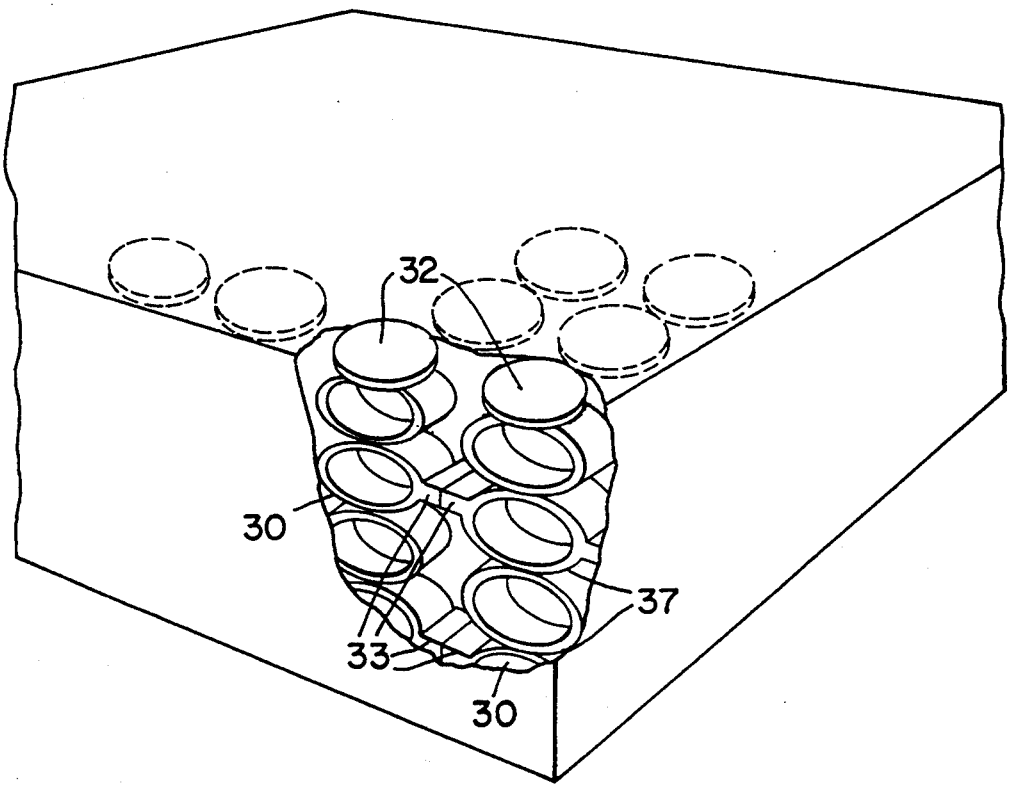

The upper mattress (FIG. 9) contains spring elements 30 between one upper support and one lower support. i.e. out of horsehair or textile fibers.

Figure 10:
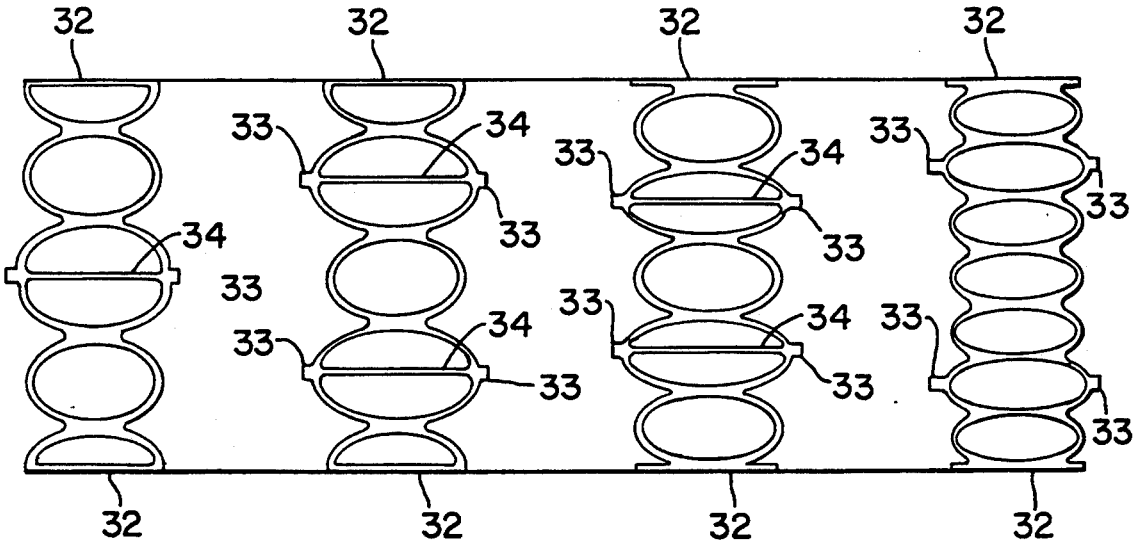
Figure 11:
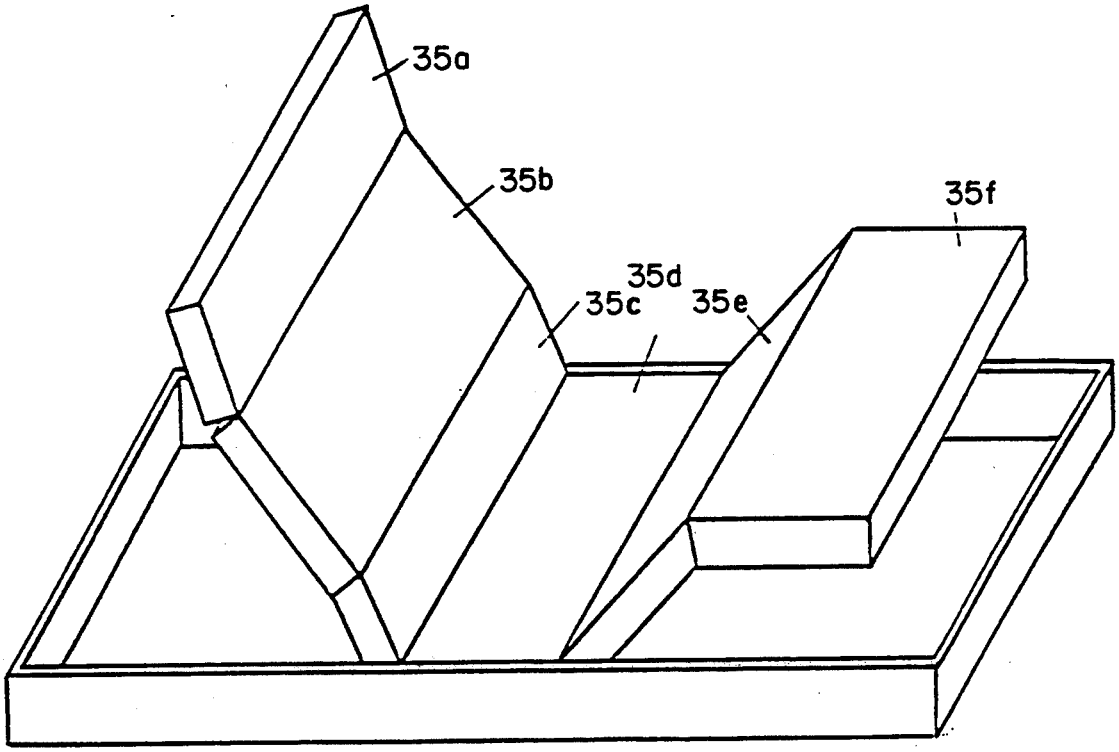

According to the invention, each spring element 30 comprises numerous tube sections 31 out of flexible material stacked on top of each other and tightly connected with each other, preferably out of an Elastomer and shows a seat 32 at its upper and lower end to support the respective rest. Individual tube sections 31 show connection elements 33 on both sides to manufacture snap connections with the neighboring spring elements. The spring elements 30 could be designed differently according to the desired spring characteristic (FIG. 10). For example, individual tube sections could contain horizontal braces for stiffening which could also serve as seats 32 when cutting the outer tube sections in half. Spring elements 30 with different characteristics could be distributed according to the local stress to be expected in the upper mattress. Even by producing or not producing snap connections between neighboring spring elements 30, local stiffness and spring characteristics of the upper mattress can be influenced.

Figure 12:
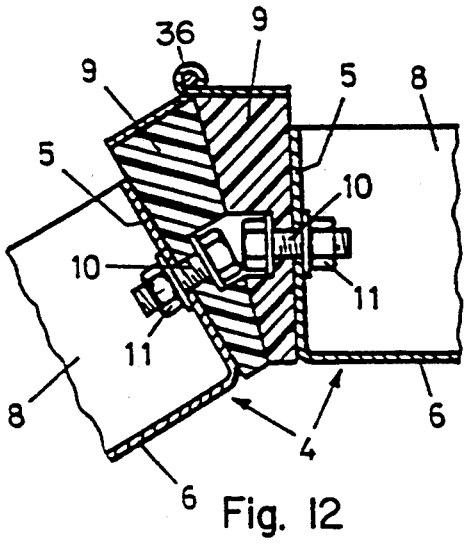
Figure 13:
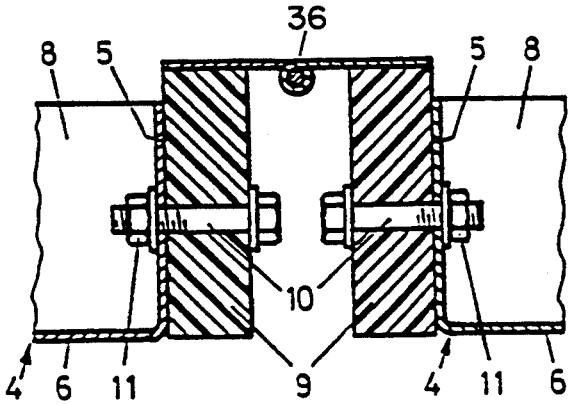

The described versions of lower- and upper mattresses are also suited for the cases (FIG. 1 1) where the lower mattress contains numerous frames 35*a,b,c,d,e,f* able to swivel against one another, which are connected by hinges 36 between cross-pieces 9 next to each other or even between side parts of frame parts bumping up against each other. The hinges are covered with bellows (not depicted) for the protection against getting fingers caught when adjusting the frame. In the indicated example, the frames 35*a,b,c* are located at the head end, and 35*e,f* at the foot end. The last ones are connected as depicted in FIG. 12. The frame parts 35*b,c* could form an obtuse angle upwards convex to support the lumbar vertebra. The manner of their connection is depicted in FIG. 13.

While the invention has been particularly shown and described with respect to the preferred embodiments, it should be understood by those skilled in the art that the foregoing and other changes in form and details may be made without departing 7 from the scope of the invention.

We claim:

1. A mattress system having an upper mattress and a lower mattress, said lower mattress comprising a frame, upwardly open carrier elements of U-shaped cross section connected to said frame, each of them including an oblong cross-piece substantially coplanar with the frame between two essentially parallel upwardly-directed side-legs laterally attached to the crosspiece, a plurality of individual elastically compressible support elements distributed over the area bounded by the frame, each fastened to a cross-piece and extending upwardly between the side-legs, said support elements overtopping the side-legs in unloaded to normally loaded state and being essentially contained between the side-legs in a state of overload.

2. The mattress system of claim 1, wherein the support elements comprise rest plates laterally extending over the side legs so as to rest against the side-legs in a state of overload.

3. The mattress system of claim 2, wherein the rest plates are arched.

4. The mattress system of claim 2, wherein the rest plates have a rough surface.

5. The mattress system of claim 1 wherein the frame is rectangular, and wherein the U-shaped carrier elements are aligned parallel to the longitudinal direction of the frame.

6. The mattress system of claim 5, wherein the frame has at least one cross-member, to which on both sides, U-shaped carrier elements lying opposite each other are fastened.

7. The mattress system of claim 6, wherein the U-shaped carrier elements have ends with lateral wails, the U-shaped carrier elements lying opposite one another on a cross-member and a bolt passes through the lateral walls of opposing U-shaped carrier elements and the cross-member on which they lie so as to bolt the opposing U-shaped carrier elements together.

8. The mattress system of claim 6, wherein the frame has a plurality of partial frames which are swingable with respect to each other and are connected by hinges.

9. The mattress system of claim 1, wherein each support element comprises at least one first tube section of elastic material which is aligned so as to be transverse to the U-shaped carrier elements.

10. The mattress system of claim 9, wherein each support element contains a second tube section of elastic material which is surrounded by the first tube section and is connected to the first tube section in a region in which the first tube section rests on the cross-piece of the U-shaped carrier element.

11. The mattress system of claim 7, wherein a spring element is arranged within the first tube section.

12. The mattress system of claim 11, wherein the spring element is a rubber cylinder having slots extending in the axial direction.

13. The mattress system of claim 11, wherein the spring dement is a foamed-material cylinder.

14. The mattress system of claim 12, wherein the spring element is a coil spring.

15. The mattress system of claim 1, wherein each U-shaped carrier element has several places prepared for the attachment of the elastic support element.

16. The mattress system of claim 15, wherein the crosspiece of the U-shaped carrier element is entirely or partially removed between the places prepared for the attachment of support elements.

17. The mattress system of claim 1, wherein the attachment of the elastic support elements in the U-shaped carrier elements is effected by snap connections.

18. The mattress system of claim 1, wherein the attachment of the elastic support elements in the U-shaped carrier elements is effected by holding bolts which extend from the side legs into the inside thereof.

19. The mattress system of claim 1, wherein the frame, the U-shaped carrier elements, and the support elements are made essentially of plastic.

20. A mattress system with a lower mattress and an upper mattress, where the upper mattress comprises, between an upper pad and a lower pad, a plurality of individual spring elements horizontally distributed over the mattress, each spring element including at least one circumferentially closed essentially cylindrical horizontal tube section made of elastic material, an essentially plane lower contact surface arranged on the lower end of the spring element and contacting the lower pad and an essentially plane upper contact surface arranged on the upper end of the spring element and contacting the upper pad, and wherein each spring element comprises a plurality of tube sections that are stacked one above the other and are firmly connected together.

21. The mattress system of claim 20, wherein at least one tube section of each spring element has a connecting element on both sides so as to permit connection with an adjacent spring element.

22. The mattress system of claim 21, wherein the connecting elements are formed so as to permit snap connections.

23. The mattress system of claim 20, wherein the spring elements are plastic.

* * * * *